United States Patent [19]

Nix et al.

[11] 4,169,653

[45] Oct. 2, 1979

[54] ELECTRICAL TERMINAL

[75] Inventors: Heinrich W. Nix, Walldorf; Eike Koster, Eppertshausen, both of Fed. Rep. of Germany

[73] Assignee: AMP Incorporated, Harrisburg, Pa.

[21] Appl. No.: 911,742

[22] Filed: Jun. 1, 1978

[30] Foreign Application Priority Data

Jun. 4, 1977 [GB] United Kingdom ..... 23865/77

[51] Int. Cl.[2] ..... H01R 13/12

[52] U.S. Cl. ..... 339/253 R; 339/256 SP

[58] Field of Search ..... 339/252, 253, 256 C, 339/256 SP, 257, 258 C, 258 S, 277 R

[56] References Cited

U.S. PATENT DOCUMENTS

| | | | |
|---|---|---|---|
| 911,032 | 2/1909 | Dow | 339/258 C |
| 1,158,930 | 11/1915 | Klinger | 339/258 C |
| 1,965,270 | 7/1934 | Werner | 339/257 |
| 3,409,867 | 11/1968 | Lessner | 339/258 S |
| 3,728,669 | 4/1973 | Churla | 339/277 R |
| 3,729,701 | 4/1973 | Smith | 339/258 S |

FOREIGN PATENT DOCUMENTS

| | | | |
|---|---|---|---|
| 2524347 | 12/1976 | Fed. Rep. of Germany | 339/258 S |

*Primary Examiner*—Joseph H. McGlynn

*Attorney, Agent, or Firm*—Allan B. Osborne

[57] ABSTRACT

An electrical terminal stamped and formed from sheet metal, comprises a base having two opposed edge portions each bent twice through ninety degress to extend first away from the base and then over the base towards the other edge portion whereby the base and edge portions together define a passage, the free ends of the edge portions together defining a slot extending axially of the base and having a substantially closed end at one end of the base and a wider portion intermediate the ends of the base, the free end of each edge portion being formed at the wider portion of the slot with serrations directed towards the free end of the other edge portion.

1 Claim, 4 Drawing Figures

ELECTRICAL TERMINAL

This invention relates to an electrical terminal.

In automobiles earth connections in the electrical system are conventionally made using self-tapping screws or bolts, and ring-tongue terminals on the wires.

Such connections are time consuming to make, and not always reliable.

According to this invention an electrical terminal stamped and formed from sheet metal, and comprising a base having two opposed edge portions each bent twice through ninety degrees to extend first away from the base and then over the base towards the other edge portion whereby the base and edge portions together define a passage, the free ends of the edge portions together defining a slot extending axially of the base, is characterised in that the slot has a substantially closed end at one end of the base and a wider portion intermediate the ends of the base, the free end of each edge portion being formed at the wider portion of the slot with serrations directed towards the free end of the other edge portion.

The terminal of this invention can be used to establish an electrical connection to a stud having a flange at one end of its shank, the flange of the stud being introduced into the passage of the terminal from the end thereof remote from the substantially closed end of the slot defined by the free ends of the edge portions of the terminal, and the terminal then being moved relative to the stud such that the shank of the stud becomes wedged in the wider portion of the slot defined by the free ends of the edge portions of the terminal, with the serrations biting into the shank of the stud.

The terminal is thus securely locked to the stud and can provide an electrical connection thereto.

The terminal of this invention is thus particularly suitable for use in automobiles for providing an earth connection. Studs as described would be welded to the automobile body where required with the flange at the free end of the stud, to receive a terminal as described above, with a wire connected thereto.

Such a method of providing earth connections gives considerable assembly advantages and increased reliability over the conventional method of providing earth connections mentioned above.

Preferably the terminal also includes an integrally formed wire connection portion extending from the end of the base remote from the substantially closed end of the slot, for crimping about the conductive core of an insulated wire and preferably also the insulation thereof, in known manner.

The base of the terminal can be formed with a projection directed towards the edge portions and aligned with the wider portion of the slot defined by the free ends thereof, which projection will engage the free end surface of the flange of a stud of which the terminal is mounted, thereby to enhance the mechanical and electrical connections between the terminal and the stud.

The base of the terminal can also be formed with an inwardly directed lance extending towards the substantially closed end of the slot defined by the free ends of the edge portions of the terminal, the free end of the lance being positioned to engage the flange of a stud on which the terminal is mounted thereby to prevent withdrawal of the flange from the passage of the terminal.

An electrical terminal according to this invention will now be described by way of example with reference to the drawings, in which.

Figure 1:
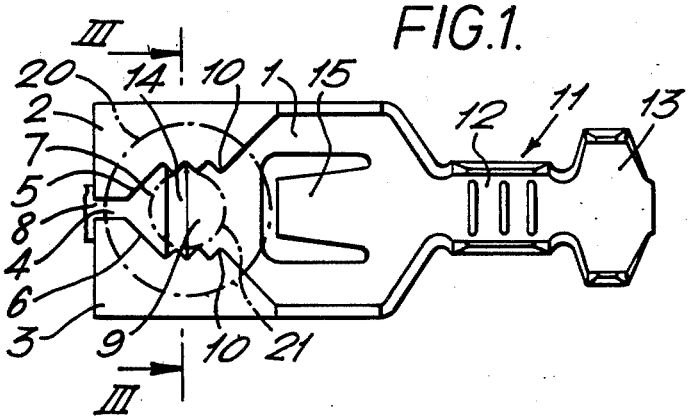
FIG. 1 is a top plan view of the terminal mounted on a stud.

The terminal is stamped and formed from sheet metal and comprises a base 1 having two opposed edge portions 2 and 3 each bent twice through ninety degrees to extend first away from the base 1, and then over the base 1 towards the other edge portion whereby the base 1 and edge portions 2 and 3 together define a passage 4.

The free ends 5 and 6 of the edge portions 2 and 3 together define a slot 7 extending axially of the base 1 and having a substantially closed end 8 at one end of the base 1, and a wider portion 9 intermediate the ends of the base 1.

The free ends 5 and 6 of the edge portions 2 and 3 are formed at the wider portion 9 of the slot 7 with serrations 10.

Integrally formed with the base 1 is a wire connection portion 11 comprising a crimping ferrule 12 for crimping about a bared end portion of the conductive core of an insulated wire (not shown), and a crimping ferrule 13 for crimping about the insulation of the wire.

The base 1 of the terminal is formed with a projection 14 directed towards the edge portions 2 and 3 and aligned with the wider portion 9 of the slot 7.

Figure 2:
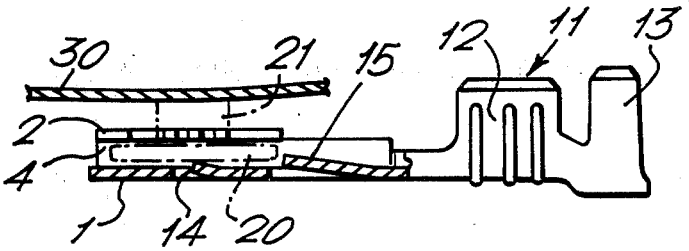
FIG. 2 is a side elevational view of the terminal mounted on a stud.
Figure 3:
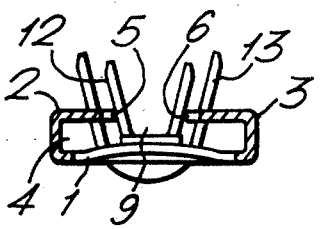
FIG. 3 is a section on the line III—III in FIG. 1 with the stud removed.
Figure 4:
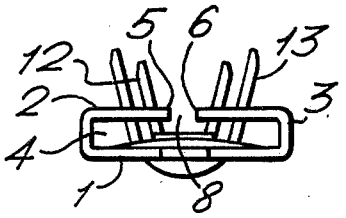
FIG. 4 is an end view of the terminal of FIG. 1 with the stud removed.

In FIGS. 1 and 2 the terminal is shown providing a mechanical and electrical connection to a stud, having a flange 20 at one end of its shank 21, for example to establish an earth connection in an automobile.

A wire would be connected to the terminal in known manner by means of the crimping ferrules 12 and 13.

To establish the connection of the flange 20 of the stud is introduced into the passage 4 of the terminal through the end thereof remote from the substantially closed end 8 of the slot 7, and the terminal is then moved relative to the stud such that the shank 21 of the stud becomes wedged in the wider portion 9 of the slot 7, with the serrations 10 biting into the shank 21 of the stud, and the projection 14 biting into the free end surfaces of the flange 20 of the stud.

The base 1 of the terminal is also formed with an inwardly directed lance 15 extending towards the substantially closed end 8 of the slot 7, the free end of the lance 15 being positioned to engage the flange 20 of the stud on which the terminal is mounted thereby to prevent withdrawal of the flange 20 from the passage 4 of the terminal.

The terminal thus becomes securely mechanically locked to the stud and an electrical connection is easily provided between the wire connected to the terminal and the body of the automobile.

What is claimed is:

1. An electrical terminal stamped and formed from a coplanar sheet of conductive material, comprising, a. an elongated base having a wire connecting portion at the back end and edge portions along either side thereof adjacent the front end, said edge portions being bent upwardly and inwardly over the base to define a passageway therebetween;

b. serrations on the facing, free end sides of the edge portions overlying the base, said serrated, free end sides cooperating to define an axially extending slot therebetween, said slot being narrow adjacent the front end of the base and wider towards the back end;

c. a projection extending obliquely upwardly from the base towards the slot; and d. a retaining lance, positioned between the projection and the back end, extending obliquely upwardly from the base towards the front end, said terminal being adapted to slidingly receive a flanged stud with the flange being positioned in the passageway and being biased upwardly against the overlying edge portions by the projection, and with the stud passing through the slot and being gripped by said serrations, further, forward movement being arrested by the narrow portion of the slot and rearward movement being prevented by the retaining lance engaging the flange.

* * * * *